US006227643B1

(12) United States Patent
Purcell et al.

(10) Patent No.: US 6,227,643 B1
(45) Date of Patent: May 8, 2001

(54) INTELLIGENT PRINTER COMPONENTS AND PRINTING SYSTEM

(75) Inventors: David A. Purcell; Richard A. Murray; Dan J. Dull, all of San Diego, CA (US)

(73) Assignee: ENCAD, Inc., San Diego, CA (US)

( * ) Notice: Subject to any disclaimer, the term of this patent is extended or adjusted under 35 U.S.C. 154(b) by 0 days.

(21) Appl. No.: 09/030,631

(22) Filed: Feb. 25, 1998

Related U.S. Application Data

(60) Provisional application No. 60/047,304, filed on May 20, 1997.

(51) Int. Cl.[7] ..... B41J 29/38; B41J 29/393
(52) U.S. Cl. ..... 347/19; 347/14; 347/19
(58) Field of Search ..... 347/14–23

(56) References Cited

U.S. PATENT DOCUMENTS

| | | | | |
|---|---|---|---|---|
| 4,268,861 | | 5/1981 | Schreiber et al. | 358/138 |
| 4,500,919 | | 2/1985 | Schreiber | 358/78 |
| 4,509,057 | | 4/1985 | Sohl et al. | 347/19 |
| 4,888,618 | | 12/1989 | Ishikawa | 355/208 |
| 4,990,004 | | 2/1991 | Kawahara et al. | 400/56 |
| 5,049,898 | | 9/1991 | Arthur et al. | 347/19 |
| 5,056,042 | * | 10/1991 | Lieb | 364/519 |
| 5,160,938 | | 11/1992 | Fargo et al. | 347/19 |
| 5,185,673 | | 2/1993 | Sobol | 358/296 |
| 5,212,546 | | 5/1993 | Arazi et al. | 358/80 |
| 5,227,809 | | 7/1993 | Carpenter et al. | 342/179 |
| 5,285,297 | | 2/1994 | Rose et al. | 358/518 |
| 5,289,208 | | 2/1994 | Haselby | 347/19 |
| 5,339,176 | | 8/1994 | Smilansky et al. | 358/504 |
| 5,345,315 | | 9/1994 | Shalit | 347/19 |
| 5,414,452 | | 5/1995 | Accatino et al. | 347/7 |
| 5,428,379 | | 6/1995 | Kaneko et al. | 347/23 |
| 5,439,302 | | 8/1995 | Andou et al. | 400/124.07 |
| 5,488,396 | | 1/1996 | Burke et al. | 347/37 |
| 5,491,540 | | 2/1996 | Hirst | 355/200 |
| 5,513,017 | | 4/1996 | Knodt et al. | 358/471 |
| 5,518,324 | | 5/1996 | Campbell et al. | 400/56 |
| 5,519,419 | | 5/1996 | Stephany et al. | 347/14 |
| 5,530,460 | | 6/1996 | Wehl | 347/19 |
| 5,566,372 | | 10/1996 | Ikeda et al. | 355/208 |
| 5,585,825 | | 12/1996 | Kneezel et al. | 347/14 |
| 5,592,202 | | 1/1997 | Erickson . | |
| 5,600,350 | | 2/1997 | Cobbs et al. | 347/19 |
| 5,608,430 | | 3/1997 | Jones et al. | 347/8 |
| 5,610,635 | * | 3/1997 | Murray et al. | 347/7 |
| 5,610,636 | | 3/1997 | Hanabusa et al. | 347/8 |
| 5,617,516 | | 4/1997 | Barton | 395/113 |
| 5,646,660 | | 7/1997 | Murray et al. | 347/59 |
| 5,672,020 | * | 9/1997 | Leonard et al. | 400/690.4 |
| 5,812,156 | | 9/1998 | Bullock et al. | 347/19 |
| 6,000,773 | | 12/1999 | Murray et al. | 347/7 |

FOREIGN PATENT DOCUMENTS

| | | | | |
|---|---|---|---|---|
| 0 412 459 A2 | | 2/1991 | (EP) | B41J/2/175 |
| 0V 571093 | * | 11/1993 | (EP) | G06K/19/07 |
| 0 668 165 A2 | | 2/1995 | (EP) | B41J/2/17 |
| 62-158049 | | 7/1987 | (JP) | B41J/3/04 |
| WO 94/11846 | * | 6/1994 | (WO) | G06K/19/077 |
| WO 96/14989 | * | 5/1999 | (WO) | B41J/11/00 |

* cited by examiner

*Primary Examiner*—John Barlow
*Assistant Examiner*—Alfred Dudding
(74) *Attorney, Agent, or Firm*—Knobbe, Martens, Olson & Bear, LLP

(57) ABSTRACT

An ink jet printer with intelligent components includes an ink jet cartridge and a roll of print media, each of which incorporate memory elements. Environmental sensors such as temperature and humidity sensors may also be provided. Data from the memory elements and environmental sensors is used to optimize printer operations, and to provide additional information to printer operators.

10 Claims, 9 Drawing Sheets

INTELLIGENT PRINTER COMPONENTS AND PRINTING SYSTEM

RELATED APPLICATIONS

This application claims priority under 35 U.S.C. §119(e) to Provisional Application Serial No. 60/047,304, filed May 20, 1997, entitled "Intelligent Printer Components and Printing System". The provisional "Intelligent Printer Components and Printing System" application is hereby incorporated by reference in its entirety.

BACKGROUND OF THE INVENTION

1. Field of the Invention

The invention relates to ink jet printers and consumable components used with them.

2. Related Art

Recently, ink jet printers have become widely used in the graphic arts industry. This has been mainly due to continuing increases in quality and throughput achievable with ink jet printers at a cost which is competitive with more traditional graphic arts production processes.

It can be appreciated that many different parameters affect the print quality achievable in ink jet printing. These parameters include ambient environmental conditions such as temperature and humidity. Also, the type of ink and type of media affect the results of the print process. In currently available ink jet printers, the user must consider these various parameters and adjust printer operation accordingly in order to maximize print quality. Although an experienced user of such printers can produce high quality prints, and maximize print speeds, considerable training and experience is required to optimize print operations.

Some efforts have been made to address this problem. For example, a small amount of intelligence has been built into ink jet printer components, most commonly the ink cartridge itself. In these systems, information such as ink color, remaining ink volume, nozzle information, etc. is provided to the printer from a memory element on the ink cartridge itself.

In some proposed printing systems, selected aspect of a printer's configuration are automatically controlled based on sensed environmental conditions. One such system is described in U.S. Pat. No. 5,617,516 to Barton. In this patent, some "operational subroutines" such as the frequency of printhead wiping and flushing are varied depending on current temperature and humidity values. U.S. Pat. No. 5,428,379 to Kaneko, et al. describes a system using fuzzy logic to control printer operation in accordance with several sensed parameters.

SUMMARY OF THE INVENTION

The present invention includes a printer having one or more intelligent components. With this system, the interaction between the ink, the media being printed on, and the environment are more fully addressed. Furthermore, the present system provides the user with desirable information regarding the status of the print job being performed, producing a more comprehensive printer optimization system than has been previously available.

The intelligent components advantageously allow automatic and/or easy manual printer optimization as well as feedback to the printer operator regarding print status, run time, etc. A printing system according to one aspect of the present invention thus retrieves information concerning ink and media characteristics as well as environmental parameters to automatically adjust aspects of the printing process in order to maximize print quality and optimize print speeds while reducing the required set up time and user training and education.

In one advantageous embodiment, the roll of media to be printed on has embedded intelligence in the form of a memory element, and the invention comprises an ink jet printer having a roll of media mounted thereon, wherein the roll of media comprises a memory element. Because the roll of media is in motion during the printing process, the memory element on the media roll holder advantageously comprises a writable RF identification tag embedded in an insert attached to an end of the roll holder. This eliminates any need to form electrical connections between an integrated circuit memory element and the printer electronics. An RF transceiver incorporated into the printer reads the information coded in the identification tag and writes information about media use to the RF identification tag. The memory element may store information regarding compatibility with certain inks, the amount of media remaining, and the thickness of the media. This information, which is made available to the printer in accordance with some embodiments of the present invention, provides the capacity for automatic printer optimizations which were previously unavailable.

Additionally, a printer according to the present invention may include environmental sensing devices such as a temperature and/or humidity sensor. From this information, dew points may be calculated, and suitable print speeds derived form the calculated dew point.

The intelligent components may also include one or more replaceable ink jet cartridges each having a memory element with ink information stored therein. When combined with an embedded memory element in the roll of media to be printed, ink/media compatibility may be judged. In addition, with information about the ink, media, and environmental conditions, a variety of parameters can be automatically adjusted to optimize printer performance without user intervention.

In one embodiment, the memory element is a multi-bit binary code formed by traces on a flex circuit attached to the ink jet cartridge. This system stores a limited amount of information, but is especially inexpensive to produce, and requires modifications to existing ink jet cartridges which do not significantly impact the interface between the ink jet cartridge and the print carriage it mounts to.

In another embodiment of the invention, the memory element on the ink jet cartridge is an integrated circuit memory which interfaces with printer electronics with a two wire connection. This embodiment allows a much wider range of information to be stored in the memory element. Preferably, the mounting of the memory element is such that a conductive connection between the memory element and the printer electronics is created automatically when the cartridge is installed in a "drop & click" type cartridge receptacle on a print carriage. Accordingly, the memory element may be mounted on a dedicated section of flex circuit which is secured to a face of the ink jet cartridge which interfaces with a mating segment of flex circuit secured to the print carriage. In such an embodiment, mounting is accomplished to minimize mechanical interference between the memory element and the print carriage when the cartridge is installed.

Advantageously, a variety of optimizations may be performed in an ink jet printer according to the present invention. Information regarding media can allow for adjustments in print carriage height, or can provide a basis for print data modification to correct for color aberrations produced by using different substrate colors. Also, ink/media mismatches can be detected and an operator warned before proceeding.

DETAILED DESCRIPTION OF THE INVENTION

Figure 1:
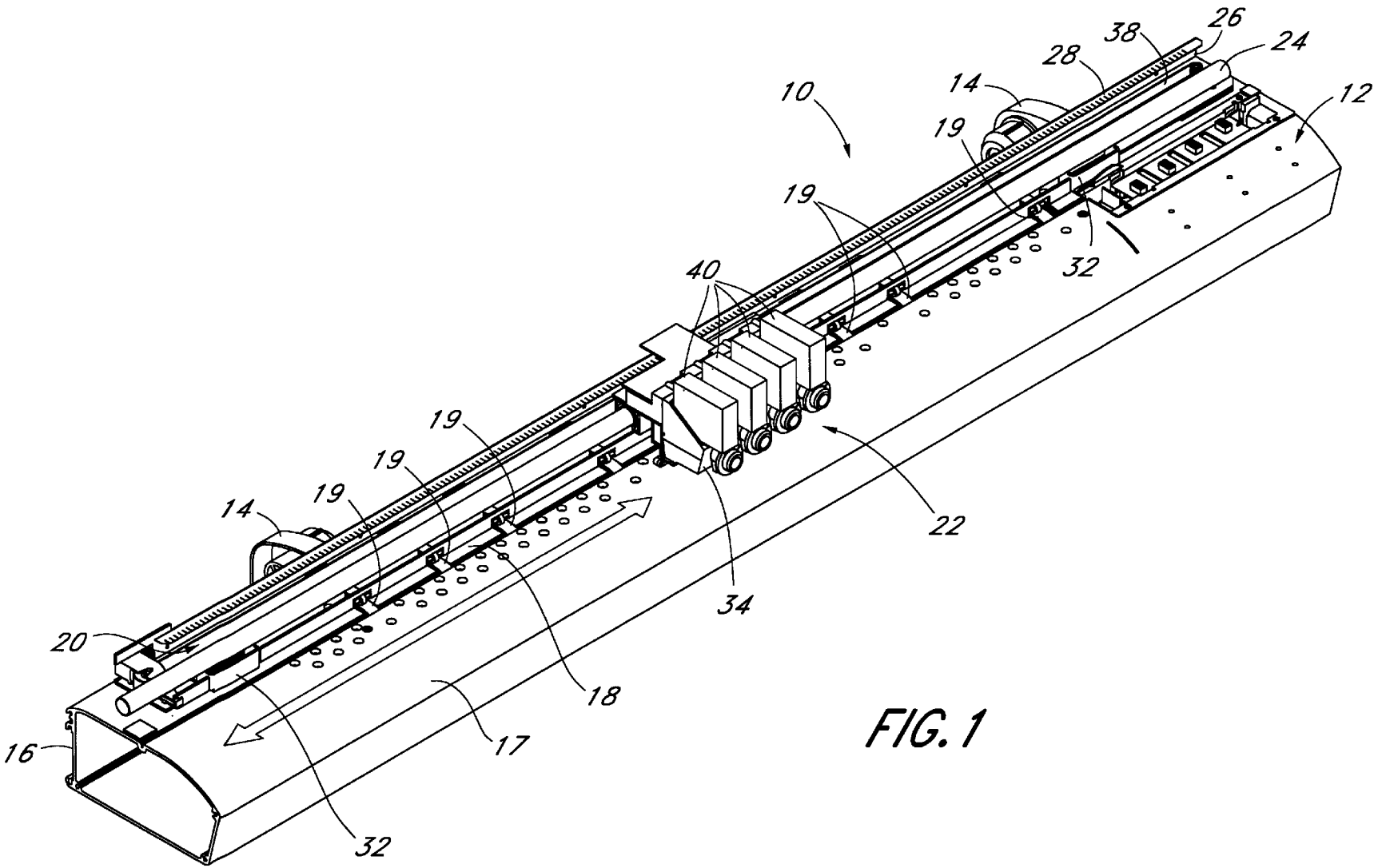
FIG. 1 is a perspective view of several structures of an ink jet printer.

Preferred embodiments of the present invention will now be described with reference to the accompanying Figures, wherein like numerals refer to like elements throughout. The terminology used in the description presented herein is intended to be interpreted in its broadest reasonable manner in accordance with its ordinary use in the art and in accordance with any overt definitions provided below.

The present invention is advantageously applied to ink jet printers. Accordingly, an overall description of a typical contemporary large format ink jet printer as manufactured by Encad Inc., assignee of this patent application, is first described with reference to FIG. 1. Referring now to this Figure, a printer carriage assembly 10 is supported on the top face of a printer housing 12, which is a part of a typical printer device. The housing 12 is supported by a pair of legs (not shown) and encloses various electrical and mechanical components related to the operation of the printer/plotter device.

A pair of roll holders 14 are mounted to a rear side 16 of the housing 12 and are slidable to accept media rolls of various widths. The roll of continuous print media (not shown in this Figure) is mounted on the roll holders 14 to enable a continuous supply of paper to be provided to the printer/plotter carriage assembly 10. Otherwise, individual sheets of paper may be fed into the rear side 16 of the housing as needed. A portion of a top side 17 of the housing 12 forms a platen 18 upon which the printing/plotting is performed by select deposition of ink droplets onto the paper. The paper is guided from the rear side 16 of the housing 10 under a support structure 20 and across the platen 18 by a plurality of drive rollers 19 which are spaced along the platen 18.

The support structure 20 is mounted to the top side 17 of the housing 12 with sufficient clearance between the platen 18 and the support structure 20 along a central portion of the platen 18 to enable a sheet of paper which is to be printed on to pass between the platen 18 and the support structure 20. The support structure 20 supports a print carriage 22 above the platen 18. The support structure 20 includes a guide rod 24 and a coded strip support member 26 positioned parallel to the longitudinal axis of the housing 12. The height of the carriage 22 above the print media is preferably controlled to a tight tolerance. Accordingly, ink jet printers have been constructed to allow for manual or automatic adjustment of the carriage 22 height above the platen 18 in order to accommodate different paper thicknesses, and one embodiment of a printer according to the present invention includes such adjustability.

The print carriage 22 includes a plurality of printer cartridge holders 34 each with a printer cartridge 40 mounted therein. The print carriage 22 also includes a split sleeve which slidably engages the guide rod 24 to enable motion of the print carriage 22 along the guide rod 24 and to define a linear path, as shown by the bidirectional arrow in FIG. 1, along which the print carriage 22 moves. A motor (not shown) and drive belt mechanism 38 are used to drive the print carriage 22 along the guide rod 24.

In a printer such as is illustrated in FIG. 1, many different parameters affect print quality. These include ambient environmental conditions such as temperature and humidity. Also, the type of ink and type of media affect the results of the print process. As mentioned above, in currently available ink jet printers, the user must consider these various parameters and adjust printer operation accordingly in order to maximize print quality. This requires a considerable amount of training and experience. It would therefore be desirable to incorporate into the printer itself sensing devices and intelligent components which communicate with electronics in the printer so as to automatically configure the printer for optimal operation. For example, measurements of ambient temperature and humidity, as well as information about ink and media type, can allow automatic calculation of appropriate ink densities, print speed, print carriage height, ink dry rate, and appropriate cutting pressure for an integral media cutting knife (not shown in FIG. 1). Optimal operating parameters which are normally a part of an experienced users knowledge base, can be effectively programmed into the printer itself. In some preferred systems, this information can be coupled with information about the print data itself to produce additional information useful to the printer operator, such as job costing, print times, etc.

Figure 2:
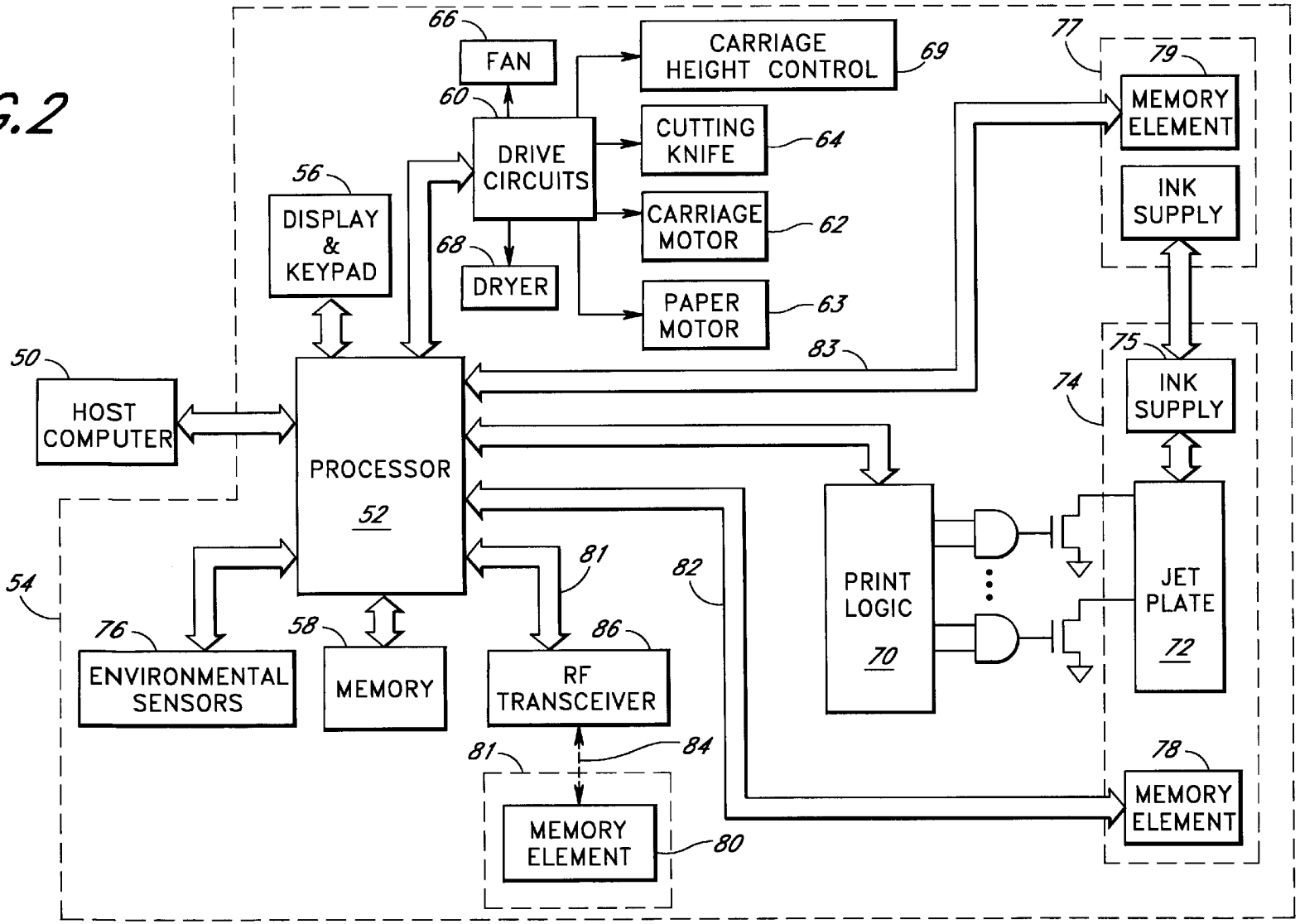
FIG. 2 is a schematic/block diagram of one embodiment of an ink jet printer according to one aspect of the present invention.

Illustrated in FIG. 2 is a schematic/block diagram of one embodiment of an ink jet printer incorporating the above described features. It will be appreciated by those of skill in the art that individual ones of the features illustrated may be separately utilized to improve at least some aspects of printer performance.

Referring now to FIG. 2, a host computer 50 communicates with a processor 52 integral with the ink jet printer. Ink jet printer components illustrated schematically in FIG. 2 including the components inside the dashed line 54. The host computer runs driver software which issues print commands and sends data to the ink jet printer. As in conventional ink jet printers, the processor 52 communicates with a display and keypad 56, memory 58, and drive circuits 60 which control the print carriage motor 62 and paper motor 63, as well as an automatic cutting knife 64, a fan 66, a dryer 68, and a carriage height control 69. In addition, the processor 52 routes signals to print logic 70, which actuates the nozzles of the jet plate 72 of each ink jet cartridge, illustrated in FIG. 2 by dashed line 74. In many embodiments of the present invention, the printer will include four ink jet cartridges, only one of which is illustrated in FIG. 2. The ink jet cartridge 74 typically includes a small ink reservoir 75 in fluid communication with the jet plate 72. This small reservoir 75 may be in communication with a large remote ink reservoir 77. The large reservoir 77 may be integral with the printer housing, or may be a user replaceable reservoir which allows swapping different ink colors or compositions. Many implementations of large volume ink reservoirs and their interconnection to ink jet cartridges are known to those of skill in the art. Some of these are described, for example, in U.S. Pat. No. 5,686,947 to Murray et al. and U.S. Pat. No. 5,369,429 to Erickson. User swappable large volume reservoirs are described in Provisional Application Serial No. 60/036,547. The disclosures of each of these documents are hereby incorporated by reference in their entirety.

In addition to the items set forth above, the processor also advantageously interfaces with environmental sensors 76, which preferably include either or both a temperature and a humidity sensor. One embodiment of the temperature sensor is an electronic temperature sensor which has a digital output indicative of the temperature of the device. Suitable temperature sensors of this nature are commercially available from Dallas Semiconductor as, for example, part number DS1820. Measuring both temperature and humidity allows a computation of the dew point at print time, and this allows a computation of ink dry time, which in turn can be used to set print speed such that adequate drying time is allowed for each print pass of the carriage 22 across the media.

In addition, the processor preferably communicates with a memory element 78 on each ink jet cartridge 74, a memory element 79 on each large volume ink reservoir 77, and a memory element 80 attached to the roll of media (indicated by dashed line 81 on FIG. 2) being used to supply the substrate being printed on. The information from the memory elements is communicated to the processor via communication links 81, 82, and 83, which may take a variety of forms. As will be explained in more detail below with reference to FIGS. 3 through 5, the memory element on the cartridge may comprise simply a trace configuration on a flex circuit provided on the ink jet cartridge. In this embodiment, the trace configuration defines a multi-bit binary code which may be interpreted by the processor. Alternatively, the memory element may comprise an integrated circuit memory which may interface with the processor via a two wire electrical interface which allows both reading from and writing to the memory element 78 by the processor 52. The same alternatives may be suitable for the memory element 79 on the large volume ink reservoir 77.

Figure 9:
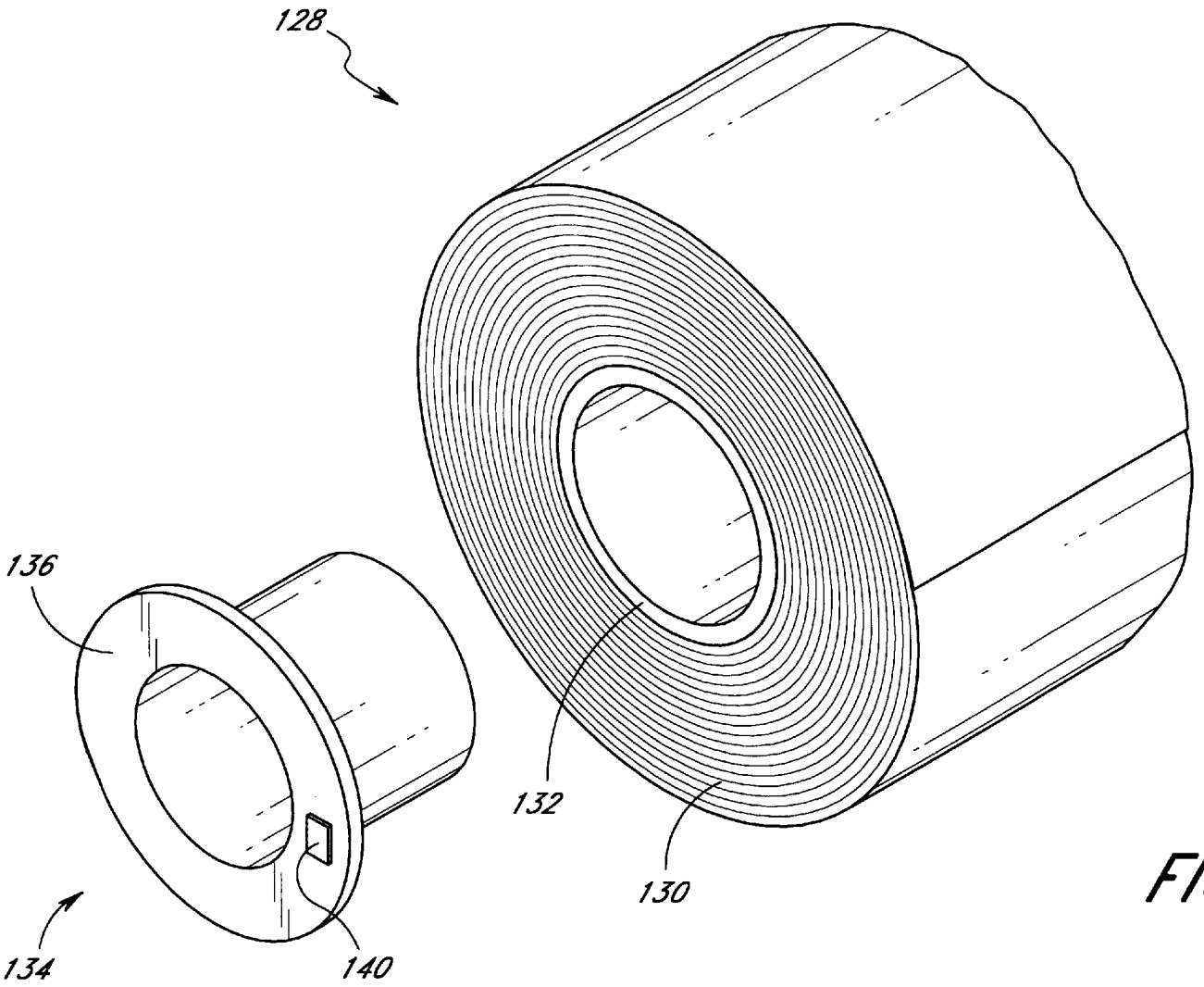
FIG. 9 is a perspective view of an end of a roll of paper media incorporating an embedded memory element.

Because the roll of media on the printer is in motion during the print process, the interface to the memory element 80 on the media roll advantageously includes a wireless link 84 which is driven by RF transceiver circuitry 86 integral to the ink jet printer stand (not shown). This and alternative interfaces to the memory element 80 on the roll of media are described in more detail below with reference to FIG. 9.

Figure 3:
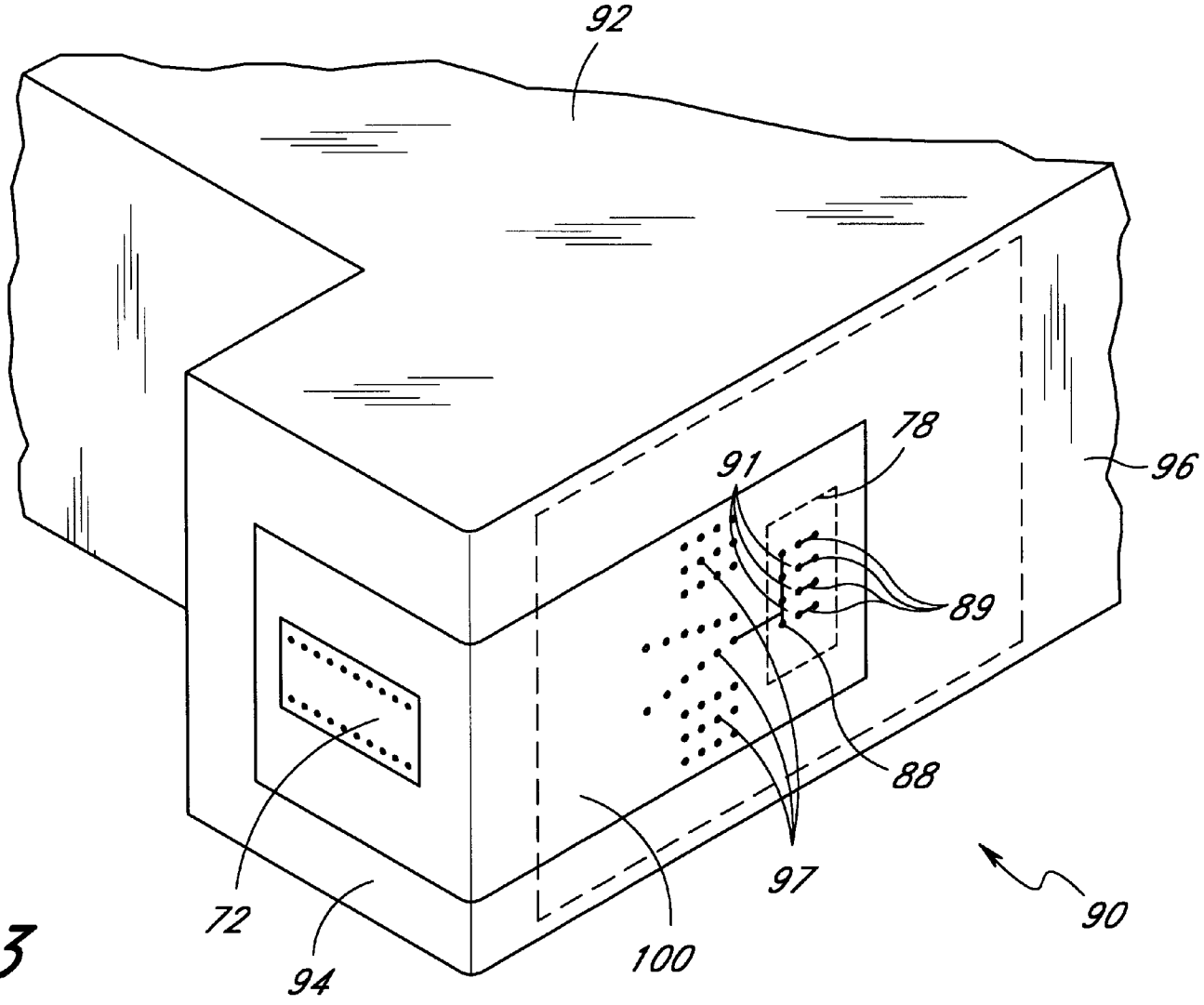
FIG. 3 is a perspective view of a portion of a cartridge including a memory element according to one aspect of the present invention.

A perspective view of a portion of an ink jet cartridge according to one aspect of the present invention is shown in FIG. 3. An ink jet cartridge 90 includes a housing 92 having a bottom surface 94 which provides a mounting surface for the jet plate 72 (also illustrated in FIG. 2). The jet plate 72 is connected to a piece of flex circuit 100 which extends from the bottom surface 94 of the cartridge 90 around a corner to the rear surface 96 of the cartridge. Circuit traces (not shown) connect the jet plate 72 to contacts 97 which mate with contacts on the print carriage so as to connect the printer electronics with the jet plate. In the embodiment illustrated in FIG. 3, the memory element 78 comprises a multi-bit binary code defined by a trace configuration. In this embodiment, the memory element 78 comprises a first trace 88 connected to the ground connection points of the jet plate drive circuitry. Four separate output pads 89 may be selectively connected to the grounded trace 88 via connection points 91 which may be left open or bridged with solder during the manufacture of the ink jet cartridge. Alternatively, the pads 89 may be selectively connected to ground by laying traces only between specific desired pads 89 and ground during the original manufacture of the flex circuit 100.

Via a mating flex circuit provided on the carriage which is described in more detail below, the output pads 89 are connected to four lines inside the printer which are tied to a positive potential through pull-up resistors. Thus, depending on which pads 89 are pulled to ground with a connection to the grounded trace, different four bit codes are delivered to the printer electronics. This allows classification of cartridge into sixteen different types. In some advantageous embodiments, the sixteen different codes represent different characteristics of ink in the cartridge. These characteristics may include color, indoor/outdoor suitability, aqueous or organic solvent based composition, etc. Of course, other cartridge parameters may also be coded into the present four bit code. It will also be appreciated that several alternative trace configuration based binary codings are possible in view of the specific implementation set forth above, including more or fewer bits, different detection circuits, etc.

Figure 4:
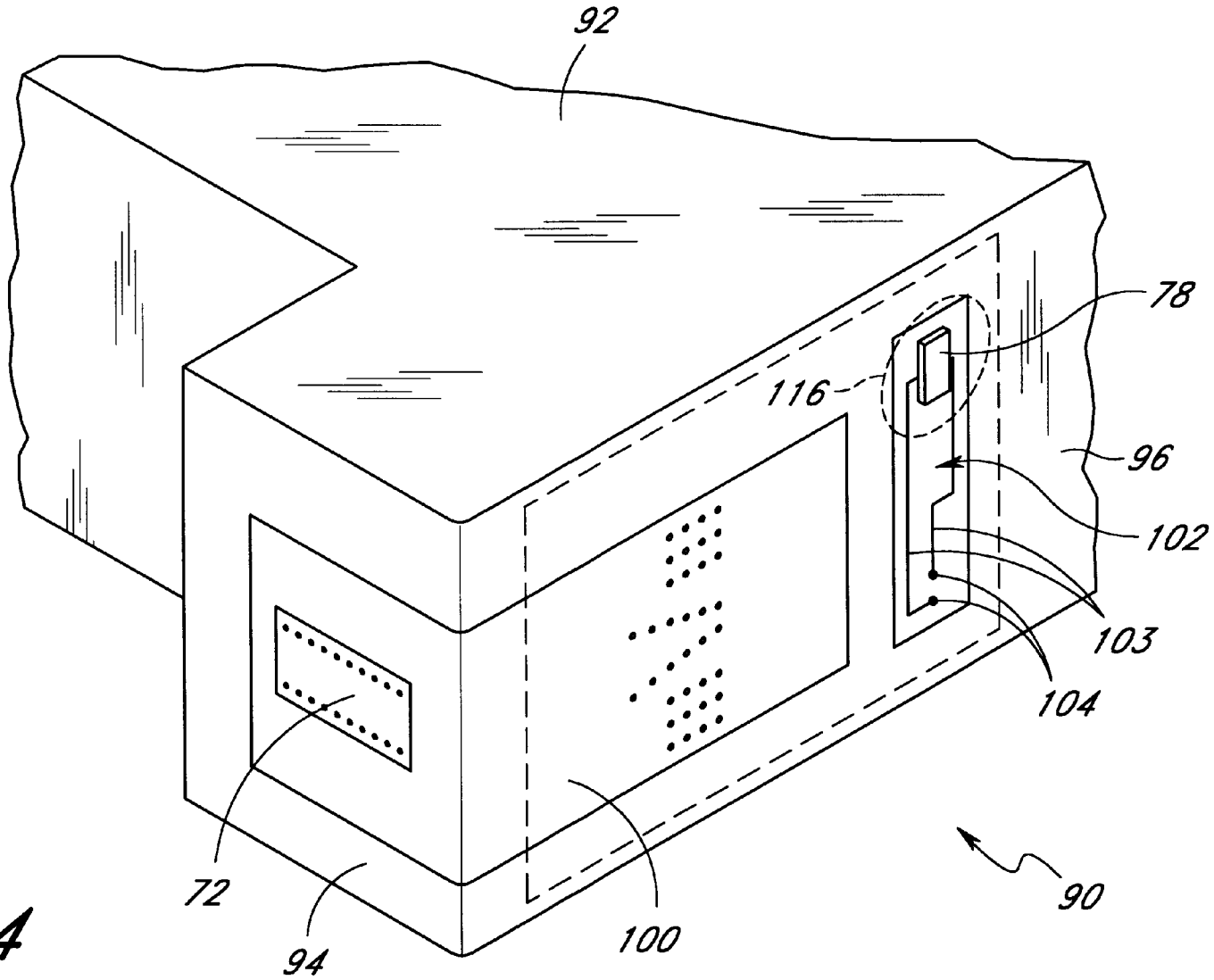
FIG. 4 is a perspective view of a portion of a second embodiment of a cartridge including a memory element according to one aspect of the present invention.
Figure 5:
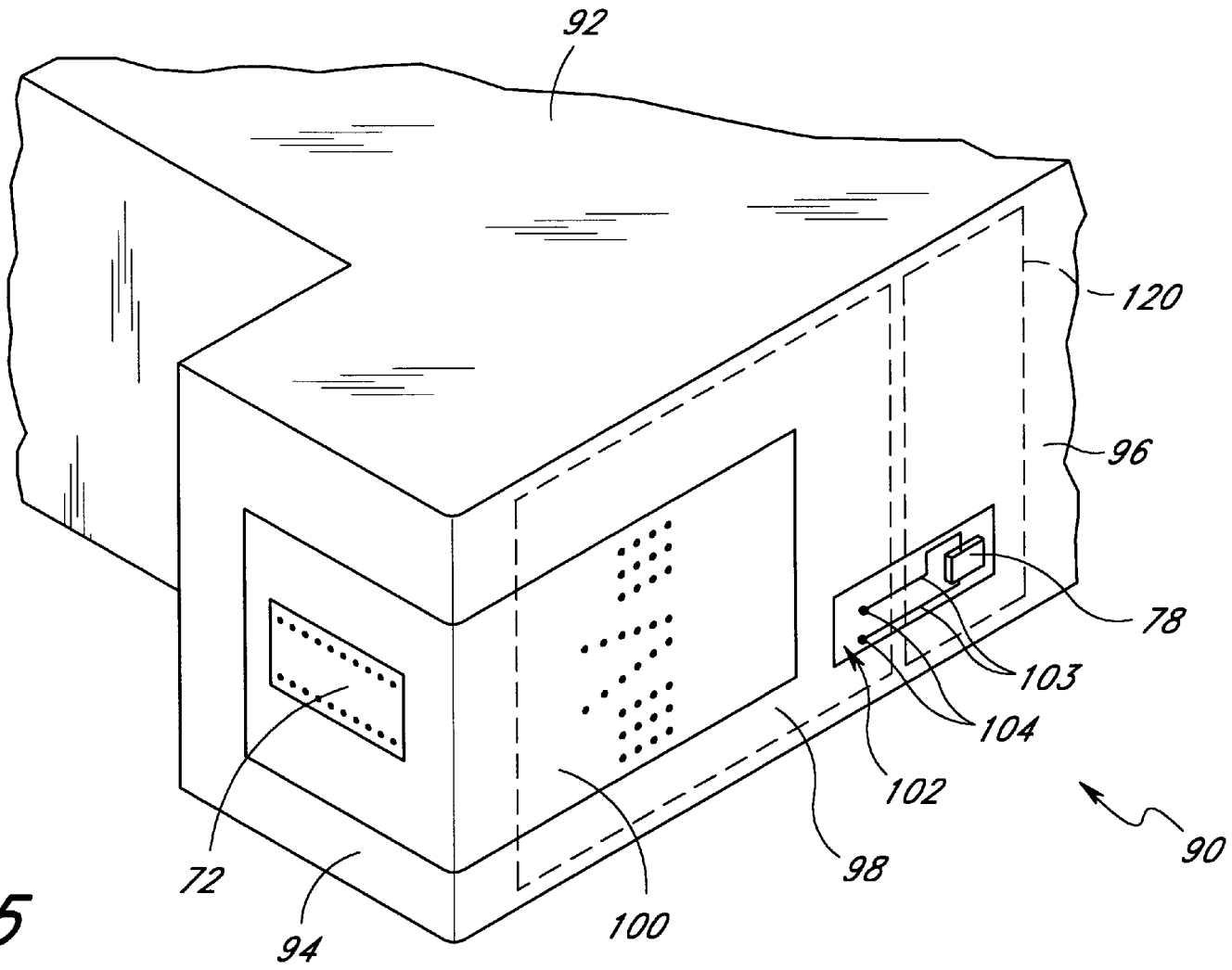
FIG. 5 is a perspective view of a portion of a third embodiment of a cartridge including a memory element according to one aspect of the present invention.

Referring now to FIGS. 4 and 5, an ink jet cartridge incorporating a memory element comprising a memory integrated circuit is illustrated. In this embodiment, a second piece of flex circuit 102 provides a mount for the memory element 78. Formed on the second flex circuit 102 are conductive traces 103 forming a two wire interface with the memory element 78. As has been mentioned above, in some advantageous embodiments of the present invention, the memory element 78 has only two electrically active terminals, one comprising a signal terminal, and one comprising a ground terminal. Memory elements which are suitable for use in some embodiments of the present invention are commercially available, for example, as part number DS2430A from Dallas Semiconductor of Dallas, Tex. These devices include 256 bits of EEPROM memory which is serially written to and read from over the one signal terminal provided. These devices also include a 48 bit serial number so that individual memory elements can be connected in parallel to a single signal line and addressed separately by an external device. Thus, a single two wire bus can be used to communicate in parallel with each of the plurality of cartridges provided on the ink jet printer.

FIGS. 4 and 5 illustrate different orientation of the flex circuit 102, depending on the configuration of the cartridge receptacle of the print carriage. In the embodiment illustrated in FIG. 4, the flex circuit 102 is adhesively secured horizontally so as to extend across the rear surface 96 of the cartridge 90, and the memory element comprises an unpackaged die which is mounted to the flex circuit 102 and connected to the two wire interface. In the configuration illustrated in FIG. 5, the flex circuit 102 is mounted vertically, and the memory element 78 comprises a low profile surface mount package which is soldered to pads on the flex circuit 102. As will be explained in more detail below, these mounting methods help alleviate interference problems which may arise from the physical presence of the memory element as the cartridge is attached to the receptacle of a print carriage. In both instances, the flex circuit 102 includes two contacts 104 for establishing an electrical connection to memory element interface circuitry which is routed to the print carriage.

Figure 6:
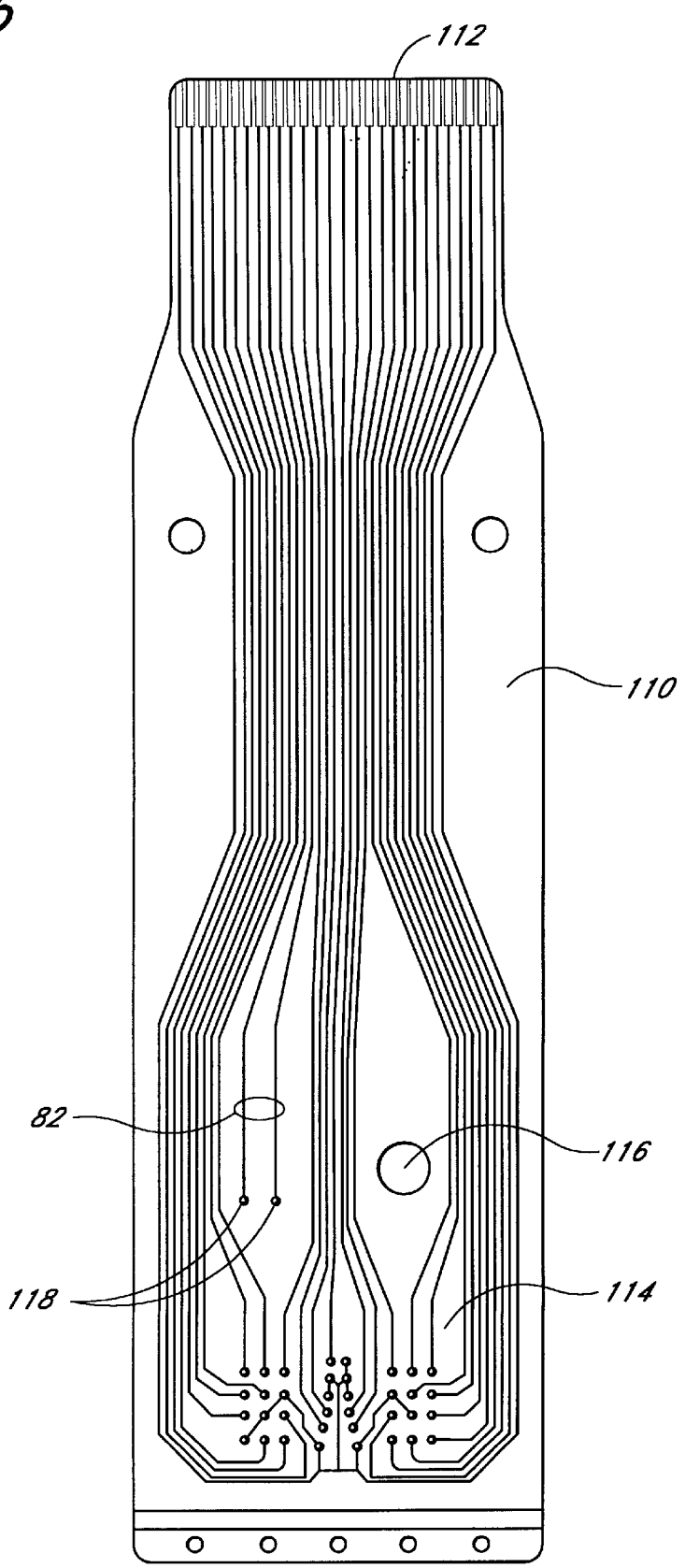
FIG. 6 is a top view of a flex circuit adapted for attachment to a print carriage and including a two wire electrical interface for printer communication with the memory element illustrated in FIG. 4.
Figure 7:
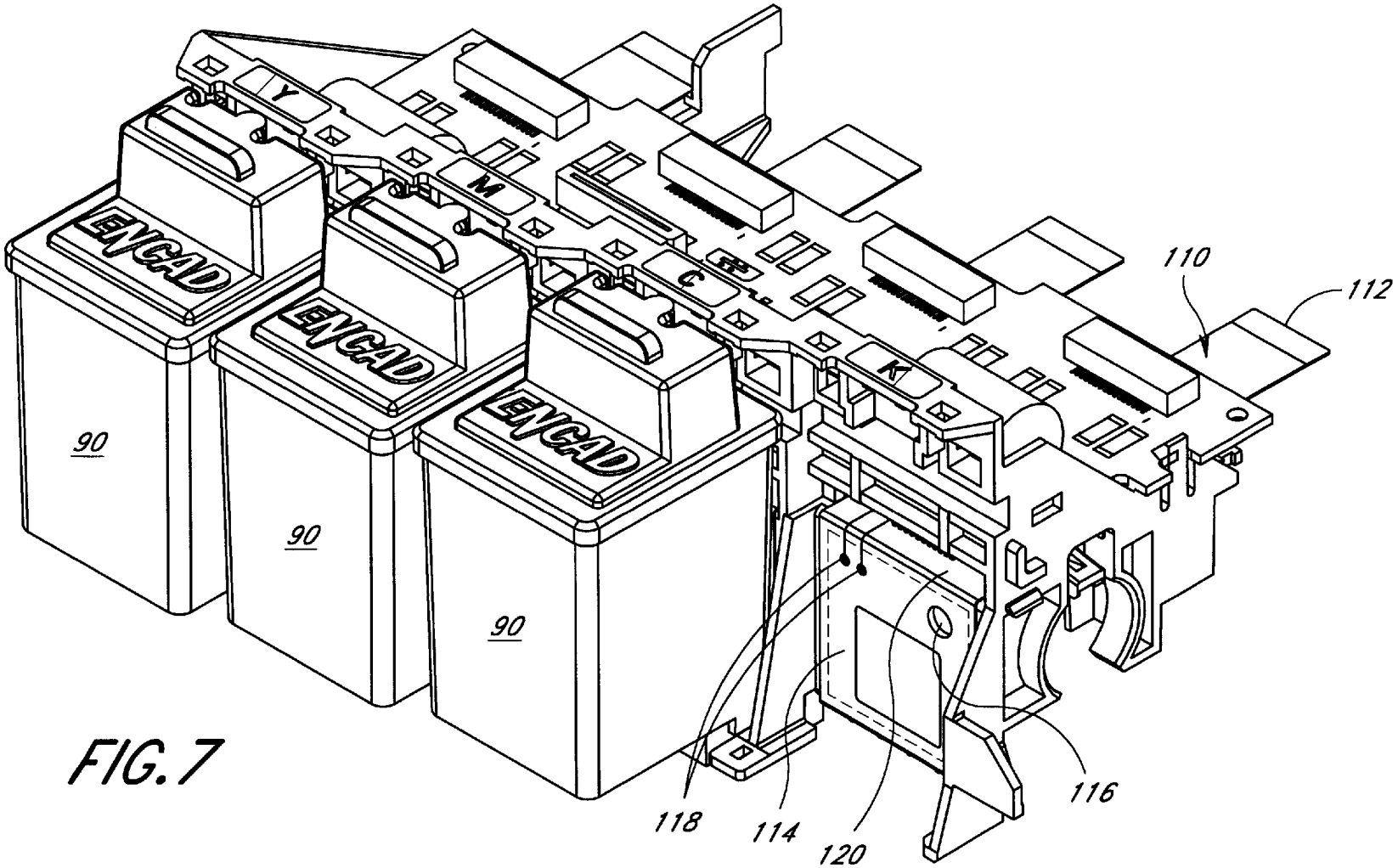
FIG. 7 is a perspective view of a print carriage showing a "drop & click" cartridge receptacle having the flex circuit of FIG. 5 attached thereon.
Figure 8:
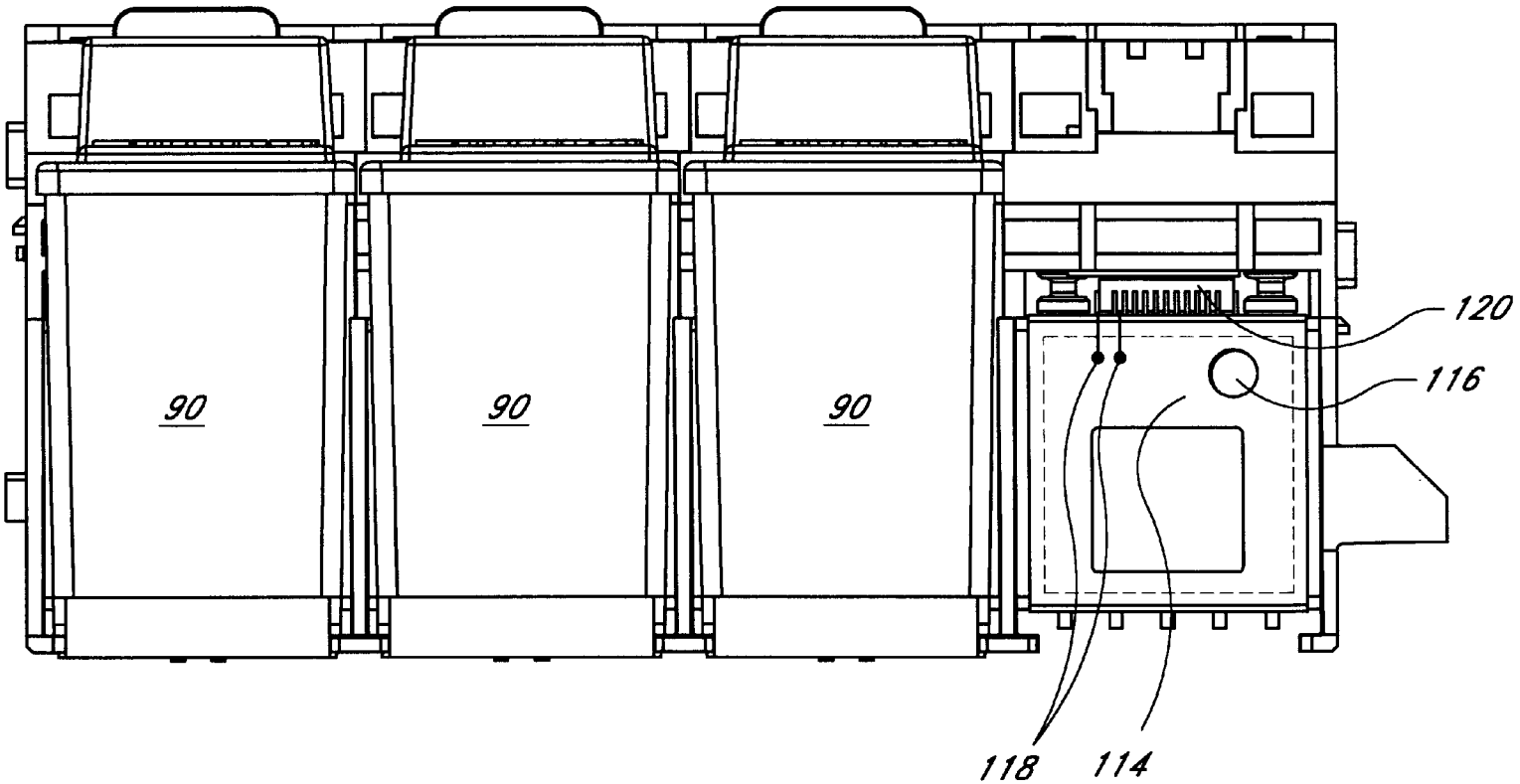
FIG. 8 is a front view of the print carriage of FIG. 6.

Referring now to FIGS. 6 through 8 in addition to FIGS. 4 and 5, the ink jet cartridge rear surface 96 includes a carriage interface portion 98, indicated in FIGS. 4 and 5 by a dashed line on the rear surface 96 of the cartridge 90. The carriage interface portion 98 of this flex circuit 100 makes contact with another flex circuit 110, illustrated in FIG. 6, which is mounted to the print carriage. The carriage mounted flex circuit 110 thus includes a printer I/O portion 112 at one end, and a cartridge interface portion 114 at the other end, which is shown in FIG. 5 as bounded by a dashed line. In some embodiments of the present invention, the flex circuit 110 further includes an aperture or cavity 116 to make space for the memory element 78 when the cartridge 90 is installed in the carriage. The flex circuit 110 also includes traces which form a portion of the two wire interface 82, and contacts 118 which connects to the contacts 104 on the cartridge flex circuit 102 which includes the memory element 78.

As shown in FIGS. 7 and 8, the flex circuit 110 is attached to the carriage such that the cartridge interface portion 114 is on a vertical surface at the rear of the cartridge receptacle. The remainder of the flex circuit 110 is threaded through a horizontally extending slot 120 in the carriage so that the printer I/O end 112 of the flex circuit 110 extends out the back of the carriage to interface with the printer electronics. It will be appreciated by examination of FIGS. 7 and 8 that when the cartridge 90 is installed into the carriage, the carriage interface portion 98 of the flex circuit 100 on the cartridge will contact the cartridge interface portion 112 of the flex circuit 110 on the carriage. This operation will connect the jet plate 72 to the printer electronics, and will also connect the two wire interface contacts 118 on the carriage to the two wire interface contacts 104 on the cartridge 90.

It can be appreciated that an integrated circuit memory element 78, being positioned on the rear surface 96 of the cartridge 90, could potentially interfere with the flex circuit 110 to flex circuit 100 contact. FIGS. 4 and 5 illustrate two alternative methods of addressing this issue. In the embodiment of FIG. 4, the flex circuit 100 is mounted horizontally, and the memory element is placed so that it extends into the aperture 116 on the carriage flex circuit 110 when the cartridge and carriage are mated. It is accordingly preferable in this embodiment to additionally include an indentation or recess in the carriage body beneath the aperture 116 so that there is sufficient space for the memory element 78 to rest between the cartridge 90 and the carriage without affecting the flex circuit mating. In the embodiment of FIG. 5, the flex circuit is mounted vertically, and the memory element 78 is located above the carriage mating portion of the flex circuit 100. In this embodiment, the memory element is positioned vertically so that it resides in the slot 120 above the flex circuit mating region when the cartridge is installed. In this embodiment as well, therefore, the memory element does not interfere with flex circuit mating when the cartridges 90 are installed in the carriage.

Of course, these techniques of avoiding mechanical interference are not required for those cartridge embodiments having a trace configuration memory element as shown in FIG. 3. In these embodiments, the flex circuit 110 attached to the print carriage need only be provided with contacts positioned to mate with the output pads 89 so as to receive the multi-bit binary code from the cartridge. In general, the space constraints are also less severe for the provision of a connection between the memory element 79 on the large volume reservoir 77 and the internal printer electronics. A flex circuit mating configuration may be used in a manner completely analagous to that described above with respect to the ink jet cartridges and the carriage. Alternativey, widely available miniature connectors could be mounted to the housing of the large volume ink reservoirs 77 which mate with mating connectors on the printer when the reservoir 77 is installed.

Those of skill in the art will appreciate that many different types of information may be stored in the memory elements 78 and 79. Information concerning cartridge volume, ink color and composition, as well as cartridge manufacturer identification and date of manufacture, may be stored. Special information concerning ink compatibility with various media types may also be included. With the provision of memory elements 78, 79 on both the large volume ink reservoirs 77 and the ink jet cartridges 74, the compatibility between large volume ink supply and the ink in the cartridge can be checked. Users may be warned in the event of a mistake in reservoir 77 or cartridge 74 installation which results in ink incompatibility.

In preferred embodiments, the printer counts how many drops of ink have been ejected from the cartridge 74, and writes information to the memory element 78 on the cartridge 74 indicating the amount of ink which has been used. This information can be used to indicate when the cartridge is approaching empty, or when it contains insufficient ink to complete the next print. In printer systems with large volume ink reservoirs 77 external to the cartridges, the information regarding the amount of ink expelled by the cartridge is used to determine if the jet plate quality has degraded to the extent requiring cartridge replacement, an event which occurs after excessive ink has been ejected from the cartridge. The printer could be configured to read the information from the cartridge memory element prior to each print, and prevent the initiation of any new print job if the information contained is incompatible with preprogrammed requirements.

As described above, a significant feature of an embodiment of the invention is to provide the roll of media being printed with an associated memory element. As shown in FIG. 8, a roll of media 128 according to one aspect of the present invention includes the media 130, which may be paper, vinyl, textile, or any other printable material. The media 130 is wound onto a center tube 132, which is typically rigid cardboard. In one embodiment, a molded plastic roll insert 134 is slidably inserted into the end of the roll 128 and is retained there with a friction fit. The insert 134 preferably includes an axially extending opening 136 so that the roll can be mounted onto a mandrel of the printer with the insert 134 in place on the end of the roll. The roll insert 134 may extend the length of the roll, or a second roll insert may be installed in the roll on the other side so that the diameter of the central opening in the roll 128 is the same on both sides.

The insert 134 may include a flange portion 136 which abuts the end of the roll 128 when the insert 134 is installed. Preferably, the flange 136 incorporates a memory element 140. One embodiment of the memory element 140 may comprise a two wire interface memory element similar in configuration to that described above which is mounted on the cartridge 90. However, because the media is in motion during the print process, this embodiment would also include a sliding or intermittent electrical contact between the stationary printer and the memory element on the moving paper. Such sliding contacts are not generally convenient and can lead to reliability problems.

Another embodiment of the memory element 140 may comprise a bar code label, although this alternative may be disadvantageous in that it is not a memory element which is capable of being written to when the roll is installed in a printer.

Accordingly, in the preferred embodiments of the present invention, a wireless connection is made to the memory element. One preferred embodiment comprises an RF ID tag embedded within the flange 136 of the insert 134. Such a tag has the capacity for receiving and storing information from the printer, as well as transmitting preprogrammed or stored information to the printer, all without a mechanical connection between the tag 140 and the stationary printer stand. The general properties of RF ID tags suitable for use with the present invention may be found in U.S. Pat. No. 4,857,893 to Carroll and U.S. Pat. No. 5,528,222 to Moskowitz et al., the disclosures of each of which are hereby incorporated by reference in their entireties. In addition, commercial RF ID tags suitable for use as described herein are available from for example, as the MICROSTAMP (™), manufactured by Micron Communications of Boise Id.

In one embodiment therefor, the stand (not shown) of the printer includes an RF transceiver (designated 86 in FIG. 2) which interacts with the memory element 140 as it passes by with each rotation of the roll 128. In some embodiments, the memory element could be a "passive" RF ID tag device. These devices interact with a magnetic field produced by the RF transceiver 86, and reflect a modulated signal which can vary depending on pre-programmed information stored in the memory element 140. The RF transceiver 86 receives this modulated signal and can read the stored information by analyzing the reflected signal. This system may be used to store information about the media itself, including its type, coating information, color, thickness, length, manufacturer and manufacturing date, lot number, etc. This system has the advantage that such passive read only RF ID tags are small and inexpensive devices.

The preferred embodiment includes a writable RF ID tag as the memory element 140. While such devices include more complex circuitry than the passive tags described above, they offer advantages such as storing information concerning the amount of media from the roll that has been used. In a manner analogous to the analysis of information stored in the cartridge memory element 78 regarding the amount of ink expelled, this media information can be used to alert the user that there is insufficient media to product the next print. Keeping track of the amount of media that has been used can be done in a variety of ways. The printer can keep track of how much paper has been advanced through the platen while the roll 128 has been installed. Alternatively, a mechanism can be incorporated into the stand to count how many revolutions the roll 128 has revolved since installation. This mechanism may comprise, for example, a reed switch mounted to the stand which is actuated each time a boss or tab (not shown) on the roll insert 134 passes the switch. Alternatively, a piece of reflective tape placed on the flange 136 of the roll insert 134 could be sensed optically by an LED/light sensor mechanism in the stand. With this system, the number of revolutions performed is stored in the memory element 140.

Storage of this information in the memory element 140 (rather than simply in internal printer memory) provides a significant advantage. Thus, the roll may be removed before it is empty if it is desired to use the printer with other media, or the roll may be removed from one printer and used on a different printer. In these cases, the printer reads the information from the memory element attached to the media roll to obtain information regarding the amount of media remaining on the roll that has been installed, even if a portion of the paper has been used in prior operations on another printer.

Thus, a printer with intelligent cartridges, media, and environmental sensing can be used to reduce the investment in training and experience required to produce high quality prints with an ink jet printer. Parameters which may advantageously be automatically adjusted include, but are not limited to: setting the appropriate carriage height based on the media thickness, adjusting the cutting knife pressure, modifying the print data to correct for color based on substrate color, and adjusting the print speed depending on the temperature and humidity measurements. Furthermore, information may be made available to the operator (either through the host software or from an integral printer LCD display) concerning ink/media compatibility, expected print times, print costs, etc. Furthermore, the printer can prevent, for example, ink-media mismatch errors from being made, can prevent unacceptable cartridges or media from being used, and can prevent an operator from beginning a print job that will not be completed without depleting the ink or media installed in the printer. Although the various printer features described above are advantageously included in a single intelligent printer and can work together as an integrated printer system, it will also be appreciated by those of skill in the art that individual aspects of the system described above, such as environmental sensing, or media or cartridge memory elements, for example, can each be individually utilized to improve printer performance separate from a single integrated system as well.

The foregoing description details certain preferred embodiments of the present invention and describes the best mode contemplated. It will be appreciated, however, that no matter how detailed the foregoing appears in text, the invention can be practiced in many ways. It should be noted that the use of particular terminology when describing certain features or aspects of the present invention should not be taken to imply that the broadest reasonable meaning of such terminology is not intended, or that the terminology is being re-defined herein to be restricted to including any specific characteristics of the features or aspects of the invention with which that terminology is associated. The scope of the present invention should therefore be construed in accordance with the appended Claims and any equivalents thereof.

What is claimed is:

1. An ink jet cartridge comprising:

a housing;

a first flex circuit having one or more circuit traces connected to contacts on a jet plate;

a second separate flex circuit having a memory element mounted thereon, wherein said memory element comprises a two-wire input/output interface, and wherein said second flex circuit comprises two circuit traces connected to said memory element.

2. An ink jet printer capable of automatically optimizing printing operations according to sensed consumable information, said ink jet printer comprising an ink jet cartridge, a moveable print carriage, and a communication interface between said ink jet cartridge and said moveable print carriage, said communication interface comprising:

a first flex circuit mounted on said moveable print carriage, said first flex circuit comprising a plurality of electrical contacts;

a second flex circuit mounted on said ink jet cartridge, said second flex circuit comprising a plurality of electrical contacts configured to mate with a first portion of said plurality of electrical contacts on said first flex circuit when said ink jet cartridge is installed in said moveable print carriage;

a third flex circuit mounted on said ink jet cartridge, said third flex circuit comprising a memory element and a plurality of electrical contacts, wherein said third flex circuit is mounted to said cartridge such that (1) said plurality of electrical contacts are configured to mate with a second portion of said plurality of electrical contacts on said first flex circuit, and (2) said memory element is positioned to avoid interfering with the mating of said pluralities of electrical contacts on said first, second, and third flex circuits when said ink jet cartridge is installed in said moveable print carriage, whereby said communication interface is effective for transferring data from said memory element to processing circuitry in said ink jet printer so that print operations may be optimized in response to said data.

3. The ink jet printer of claim 2, additionally comprising:

a roll of print media;

a second memory element attached to said roll of print media, whereby print operations are optimized in response to data stored in said second memory element.

4. An ink jet printer comprising an ink jet cartridge, a moveable print carriage, and a communication interface between said ink jet cartridge and said moveable print carriage, said communication interface comprising:

a first flex circuit mounted on said moveable print carriage, said first flex circuit comprising a plurality of electrical contacts;

a second flex circuit mounted on said ink jet cartridge, said second flex circuit comprising a plurality of electrical contacts configured to mate with a first portion of said plurality of electrical contacts on said first flex circuit when said ink jet cartridge is installed in said moveable print carriage;

a third flex circuit mounted on said ink jet cartridge, said third flex circuit comprising a memory element and a plurality of electrical contacts, wherein said third flex circuit is mounted to said cartridge such that (1) said plurality of electrical contacts are configured to mate with a second portion of said plurality of electrical contacts on said first flex circuit, and (2) said memory element is positioned to avoid interfering with the mating of said pluralities of electrical contacts on said first, second, and third flex circuits when said ink jet cartridge is installed in said moveable print carriage.

5. The ink jet printer of claim 4, wherein said memory element is positioned to reside in a cavity provided in said first flex circuit.

6. A method of controlling print operations of an ink jet printer comprising the steps of:

obtaining information indicative of a color of print media on which ink is to be deposited from a memory element attached to a carrier of said print media;

modifying print data received from a host computer system to produce modified print data that corrects for color aberrations produced by said color of said print media; and ejecting ink onto said print media in accordance with said modified print data.

7. An ink jet printer comprising:

a humidity sensor having an output representing ambient humidity;

a temperature sensor having an output representing ambient temperature; and printer control electronics coupled to said humidity sensor output and said temperature sensor output, wherein said printer control electronics is configured to calculate a dew point from said outputs and to control printer operations in response to said dew point.

8. The ink jet printer of claim 7, wherein said printer control electronics controls print speed in response to said calculated dew point.

9. A method of controlling the operation of an ink jet printer comprising the steps of:

sensing ambient temperature;

sensing ambient humidity;

calculating a dew point from said ambient temperature and said ambient humidity; and calculating a print speed from said dew point.

10. The method of claim 9, additionally comprising the steps of:

calculating an expected print time from said print speed and print data to be used in a print job; and displaying said expected print time to a printer operator.

* * * * *